US007074245B2

(12) United States Patent
Kurahashi et al.

(10) Patent No.: US 7,074,245 B2
(45) Date of Patent: Jul. 11, 2006

(54) MODIFIED REGENERATED CELLULOSE FIBER AND FIBER PRODUCT THEREOF

(75) Inventors: Itsuo Kurahashi, Gotenba (JP); Masatoshi Kudou, Shizuoka-ken (JP); Hiroaki Tanibe, Gotenba (JP); Koji Ando, Koshigaya (JP)

(73) Assignee: Fuji Spinning Co., Ltd., Tokyo (JP)

( * ) Notice: Subject to any disclaimer, the term of this patent is extended or adjusted under 35 U.S.C. 154(b) by 0 days.

(21) Appl. No.: 10/963,644

(22) Filed: Oct. 14, 2004

(65) Prior Publication Data

US 2005/0044643 A1 Mar. 3, 2005

Related U.S. Application Data

(62) Division of application No. 10/173,884, filed on Jun. 19, 2002, now Pat. No. 6,821,304.

(30) Foreign Application Priority Data

Jun. 21, 2001 (JP) ..... 2001-187436

(51) Int. Cl.
*D06P 3/68* (2006.01)
*D06P 3/86* (2006.01)

(52) U.S. Cl. ..... 8/666; 8/543; 8/538; 8/478; 8/481; 8/921

(58) Field of Classification Search ..... 8/666, 8/921, 543, 478, 538, 481
See application file for complete search history.

(56) References Cited

U.S. PATENT DOCUMENTS

| | | | |
|---|---|---|---|
| 2,102,789 | A | 12/1937 | Dreyfus et al. |
| 3,325,470 | A | 6/1967 | Ribka |
| 3,802,835 | A | 4/1974 | Prieto |

FOREIGN PATENT DOCUMENTS

| | | |
|---|---|---|
| FR | 785752 | 8/1935 |
| GB | 489727 | 8/1938 |
| GB | 489858 | 8/1938 |
| GB | 879071 | 10/1961 |

*Primary Examiner*—Margaret Einsmann
(74) *Attorney, Agent, or Firm*—Birch, Stewart, Kolasch & Birch, LLP

(57) ABSTRACT

A modified regenerated cellulose fiber which enables dyeing in different colors by combining the modified regenerated cellulose fiber and other fibers by means of mixed spinning or union knitting/weaving.

The modified regenerated cellulose fiber can be obtained by adding 0.5–3.0% by weight of a grounder of naphthol dye to the regenerated cellulose fiber in a matrix of the regenerated cellulose fiber, the grounder being selected from the group having a medium to high level of affinity to the regenerated cellulose fiber. A variety of dyed fiber products can be obtained by treating yarn or knitted/woven fabric made of the above modified regenerated cellulose fiber with a developer of naphthol dye.

4 Claims, No Drawings

MODIFIED REGENERATED CELLULOSE FIBER AND FIBER PRODUCT THEREOF

This application is a Divisional of application Ser. No. 10/173,884, filed on Jun. 19, 2002, now U.S. Pat. No. 6,821,304, and for which priority is claimed under 35 U.S.C. § 120; and this application claims priority of Application No. 2001-187436 filed in Japan on Jul. 24, 2001 under 35 U.S.C. § 119; the entire contents of all are hereby incorporated by reference.

BACKGROUND OF THE INVENTION

1. Field of the Invention

The present invention relates to a modified regenerated cellulose fiber containing a grounder of naphthol dye, which can be dyed by treating it with a developer of naphthol dye when it is used alone or as a mixed yarn or union knitted/woven fabric, and enables dyeing melange yarn or union knitted/woven fabric in different colors, and also relates to dyed fiber products thereof.

2. Description of Related Art

It is well known that a dyeing method for cellulose-based fiber using a naphthol dye is one in which two kinds of dye intermediates composed of a grounder and a developer are absorbed in cellulose-based fiber in a solubilized state, separately followed by reacting to form water insoluble azo dyes on cellulose-based fiber, and that various hues can be obtained depending on combinations of a grounder (naphthol ASs) and a developer (bases, salts).

Naphthol dye has the features that it can provide a vivid hue mainly in reddish color and a deep color with a high fastness. While reactive dyes are mainly used for cellulose-based fiber, naphthol dyes are also used especially for a deep color with reddish hue. However, a dyeing process using naphthol dye is much more complicated compared with that using a reactive dye or the like. In the dyeing process using a naphthol dye, in order to dissolve a grounder (naphthol ASs) which is insoluble in water, it is necessary to make the grounder mud-like by adding a surfactant such as Turkey red oil or a dissolving agent such as ethanol, which is then dissolved carefully in a large amount of hot aqueous solution of sodium hydroxide. Since this process requires great skills in using an alkaline solution and controlling the pH and also has diversified steps depending on which of the bases or salts are selected as a developer to be used in the subsequent step, it is difficult to secure skilled dyeing workers. Thus, an improvement of this process has been required.

Spinning of a spinning solution mixed with a solid substance such as titanium oxide has been conventionally carried out. However, in the case of a spinning solution containing a liquid substance, the liquid substance is thought to flow out into the spinning bath. The present inventor has noticed that a solution of grounder of naphthol dye can be added and mixed into a spinning solution because the spinning solution in a viscose process or a cuprammonium process is alkaline, and that the flowing out of the grounder into the spinning bath is little, and thus completed the present invention.

BRIEF SUMMARY OF THE INVENTION

Objects of the present invention is to simplify the complicated dyeing process using a naphthol dye, and also to provide a modified regenerated cellulose fiber which enables the dyeing of melange yarn or of union knitted/woven fabric in different colors with a naphthol dye even in piece-dyeing, by combining a modified regenerated cellulose fiber of the present invention with other fibers by means of mixed spinning or union knitting/weaving, as well as the dyed fiber products thereof.

To solve the above-described problems, a modified regenerated cellulose fiber as developed which contains 0.5–3.0% by weight, based on the regenerated cellulose fiber, of a grounder of naphthol dye selected from the group having a medium to high level of affinity to the regenerated cellulose fiber, in a matrix consisting of the regenerated cellulose fiber. Since the modified regenerated cellulose fiber of the present invention can be dyed only with a developer, the conventional dyeing process using a naphthol dye can be remarkably simplified. At the same time, as this method gives little or no staining to other fibers, it becomes possible to dye a melange yarn or an union knitted/woven fabric in different colors by piece dyeing using a naphthol dye, by combining the modified regenerated cellulose fiber and other fibers by means of mixed spinning or union knitting/weaving, and obtain a variety of fiber products.

BRIEF DESCRIPTION OF THE PREFERRED EMBODIMENTS

In the present invention, a grounder of naphthol dye is contained in a matrix of regenerated cellulose fiber by adding and mixing a grounder of naphthol dye in a spinning solution to produce regenerated cellulose fiber, followed by spinning. Thus, the grounder must be selected considering not only hue but also an affinity to regenerated cellulose fiber.

As a grounder of naphthol dye to be used in the present invention, those selected from the group having a medium to high level of affinity to regenerated cellulose fiber are suitable. These grounders are preferable because they seldom flow out from the fiber in a spinning process of regenerated cellulose fiber and provide deep color since the coupling reaction in the fiber is not inhibited during the dyeing step with a developer. A grounder in the group having a medium level of affinity to regenerated cellulose fiber includes Colour Index Azoic Coupling Component (hereinafter abbreviated as C.I.A.C.C.) 11, C.I.A.C.C. 12, C.I.A.C.C. 17, C.I.A.C.C. 19 and the like described in Azoic Section of Color Index, Second Edition, 1956, Vol. 3, printed and published from Chorlcy & Pickersgil Ltd. A grounder in the group having a high level of affinity to regenerated cellulose fiber includes, for example, C.I.A.C.C. 4, C.I.A.C.C. 10, C.I.A.C.C. 23 and C.I.A.C.C. 28 and the like.

A grounder such as C.I.A.C.C. 2, C.I.A.C.C. 14 and C.I.A.C.C. 18 and the like in the group having a low level of affinity to regenerated cellulose fiber is not preferable due to a problem that it can not provide a deep color in the dyeing step using a developer because it tends to flow out into the spinning bath during the spinning process, in which the grounder is added and mixed into a spinning solution to produce regenerated cellulose fiber followed by spinning, and does not remain in the regenerated cellulose fiber.

On the other hand, a grounder such as C.I.A.C.C. 3, C.I.A.C.C. 13 and C.I.A.C.C. 32 and the like in the group having a higher to highest level of affinity to regenerated cellulose fiber is also not preferable due to a problem that it can not provide deep color in the dyeing step using a developer because the grounder is fixed in the fiber by a strong interaction with the cellulose molecules in the fiber and a coupling reaction with a developer in the dyeing step is inhibited, although leakage from the regenerated cellulose fiber is small in the spinning process, in which the grounder is added and mixed into a spinning solution to produce regenerated cellulose fiber followed by spinning.

The present invention provides a modified regenerated cellulose fiber which contains 0.5–3.0% based on the regenerated cellulose fiber of a grounder of naphthol dye selected from the group having a medium to high level of affinity to regenerated cellulose fiber. The amount of grounder to be contained in a matrix of the modified regenerated cellulose fiber may be suitably determined within the above range, depending on the desired deepness of hue. A content of less than 0.5% is not preferable because it gives only a light color, even if dying is conducted using an increased concentration of a developer. A content of more than 3.0% is also not preferable due to a lowering of tensile strength as well as a saturation in deepness of hue.

The regenerated cellulose fiber to be used in the present invention may be produced by either viscose process or cuprammonium process. In order to mix a grounder of naphthol dye uniformly in a spinning solution to produce regenerated cellulose fiber, it is preferable that a grounder is made mud-like in advance by using a surfactant such as Turkey red oil or a dissolving agent such as ethanol and then dissolved in a large amount of hot aqueous alkaline solution (sodium hydroxide and the like). Since the spinning solution to produce regenerated cellulose fiber by viscose process or cuprammonium process is alkaline, it is suitable to dissolve a grounder of naphthol dye. The present invention can also be applied to a regenerated cellulose fiber produced by a dry spinning process. In the case of a spinning solution to produce a regenerated cellulose fiber by the dry spinning process, a grounder of naphthol dye, which is soluble or finely dispersible in a solvent to be used such as N-methylmorpholine-N-oxide and the like, may be used.

The dyeing method for a modified regenerated cellulose fiber of the present invention containing a grounder of naphthol dye in the fiber matrix is preferably performed by coloring using a mixed solution of salts as a developer of naphthol dye, weak alkaline pH regulator such as sodium acetate and a surfactant as a penetrating agent at a liquor ratio of 1:10–30 at 20–50° C. for 10–30 minutes, followed by ordinary soaping or scouring/bleaching treatments. The salts to be used includes Color Index Azoic Diazo Component (hereinafter abbreviated as C.I.A.D.C.) 3, C.I.A.D.C. 20 and the like, and suitably selected depending on a desired hue and deepness. This dyeing method provides dyed goods of medium color to deep color with a superior color fastness.

A dyeing method for combined fibers of a modified regenerated cellulose fiber of the present invention and other cellulose-based fiber such as ordinary regenerated cellulose fiber, cotton and hemp etc. by means of mixed spinning or union knitting/weaving is preferably performed by coloring using a solution containing a developer of naphthol dye followed by scouring/bleaching treatments, because a grounder contained in the matrix of modified regenerated cellulose fiber dissolves in alkaline condition. The dyed goods obtained by this dyeing method become melange-yarn-like or yarn-dyeing-like knitted/woven fabric because staining of the cellulose-based fiber is very slight staining. Further, as ordinary dyeing using a reactive dye is also possible, dyed goods in various different colors can be obtained.

Further, a modified regenerated cellulose fiber of the present invention can also be combined with other natural fibers such as wool or silk by means of mixed spinning or union knitting/weaving. Since dyeing conditions for a modified regenerated cellulose fiber using a solution of developer of naphthol dye are weakly face at low temperature, wool or silk is hardly damaged and can be dyed subsequently by the ordinary method in a neutral to weakly acidic area. Due to less damage of a modified regenerated cellulose fiber under these dyeing conditions, a melange-yarn-like or yarn-dyeing-like knitted/woven fabric with a superior feeling can be obtained.

The present invention provides an effect that the dyeing process using a naphthol dye which has been complicated until now can be simplified to a process only for a developing treatment. Further, the present invention has another effect to provide a modified regenerated cellulose fiber which enables dyeing in different colors of a melange yarn or union knitted/woven fabric in piece-dyeing by combining a modified regenerated cellulose fiber of the present invention and other cellulose-based fibers by means of mixed spinning or union knitting/weaving. Still further, since the present invention does not require a conventional treatment to use strong alkali, fibers such as wool and silk which are less resistant to alkali can be combined with the modified regenerated cellulose fiber of the present invention by means of mixed spinning or union knitting, enabling dyeing in different colors of a melange yarn or union knitted/woven fabric by piece-dyeing. Thus, the modified regenerated cellulose fiber of the present invention is suitable for use in a vast area of clothing.

EXAMPLES

Hereinbelow, the present invention will be specifically described with examples, but the present invention should not be restricted within these scopes. The fineness, tensile strength at standard state, tensile strength wet state, knot strength, elongation, content of a grounder of naphthol dye, dyeability and color fastness in these examples were measured in accordance with the following methods.

Measuring Methods for Fineness, Tensile Strength at Standard State, Tensile Strength in Wet States, Knot Strength and Elongation Measurements were conducted in accordance with JIS L 1015 "Test method for man-made fibers".

Measuring Method for Content of a Grounder of Naphthol Dye

A test solution was prepared by accurately weighing around 1 g of a modified regenerated cellulose fiber sample containing a grounder of naphthol dye then extracting the grounder by treating the sample in 100 ml of 0.1 N sodium hydroxide at 50° C. for 1 hr with gentle stirring. An absorbance of the test solution at the maximum absorption wavelength was measured with a spectrophotometer (model: DU640, made by Beckman Instruments Inc.) to determine a concentration of the grounder using a calibration curve prepared in advance. A content of grounder of naphthol dye in the modified regenerated cellulose fiber was calculated by the following equation.

$$\text{Content of Grounder (\%)} = \frac{\text{Concentration of Grounder in Test Solution (g)}}{\text{Amount of Sample (g)}} \times 100$$

Measuring Method for Dyeability

Dyed sample was measured using a spectrophotometer (model: SICOMUC-20, made by Sumika Chemical Analysis Service Ltd.), and then K/S value, an optical density at the maximum absorption wavelength, was calculated by the following Kubelka-Munk's Equation:

$$K/S \text{ value} = \frac{(1-R)^2}{2R} \times 100$$

wherein, K, S and R show absorption coefficient, scattering coefficient and reflectance at the maximum absorption wavelength, respectively.

Measuring Method for Color Fastness

Color fastness to light: was measured in accordance with JIS L 0842 "Test method for color fastness to ultraviolet carbon arc lamp light".

Color fastness to washing: was measured in accordance with JIS L 0844 "Testing method for color fastness to washing".

Color Fastness to Rubbing: was measured in accordance with JIS L 0849 "Test method for color fastness to rubbing".

Example 1

A mixture of 50 g of C.I.A.C.C. 2 (Grounder, trade name: Kako Grounder AS, made by Showa Chemical Co., Ltd.), 40 g of ethanol, 25 g of Turkey red oil and 50 g of pure water was made mud-like, then dissolved under stirring in a hot sodium hydroxide solution prepared by adding 285 g of pure water to 50 g of 48% aqueous sodium hydroxide solution heated at 60° C. Subsequently, about 500 g of pure water was further added so that a concentration of C.I.A.C.C. 2 became 5.0% to obtain 1000 g of stock solution containing 5.0% of C.I.A.C.C. 2.

Similarly, 1000 g of stock solution containing 5.0% of a grounder of naphthol dye, C.I.A.C.C. 12 (trade name: Kiwa Grounder ITR, made by Kiwa Chemical Industries Inc.), 1000 g of stock solution containing 5.0% of a grounder of naphthol dye, C.I.A.C.C. 10 (trade name: Kako Grounder E, made by Showa Chemical Co., Ltd.), and 1000 g of stock solution containing 5.0% of a grounder of naphthol dye, C.I.A.C.C. 13 (trade name: Naphtol Grounder AS-SG, made by Dystar Japan Ltd.) were prepared, respectively.

Each of the prepared stock solutions containing grounders of naphthol dye was added and mixed to polynosic viscose solution (cellulose 5.0%, total alkali 3.5%, total sulfur 3.0%) so that each grounder of naphthol dye became 2.0% to the weight of cellulose in the polynosic viscose solution. Each of the spinning solutions was immediately extruded into a spinning bath containing 22.0 g/l of sulfuric acid, 65.0 g/l of sodium sulfate and 0.5 g/l of zinc sulfate at 35° C. at a spinning speed of 30 m/min through a multihole nozzle having 500 holes with a diameter of 0.07 mm, then fibers was drawn twofold in a bath containing 2.0 g/l of sulfric acid and 0.05 g/l of zinc sulfate at 25° C. The drawn fibers were cut into 38 mm length, followed by a relaxation treatment in a bath containing 1.0 g/l of sodium carbonate and 2.0 g/l of sodium sulfate at 60° C. After that, the fibers were treated again in a bath containing 5.0 g/l of sulfuric acid at 65° C., followed by washing and oil treatment to obtain about 1000 g each of modified regenerated cellulose fiber of about 1.40 decitex without any fibers break, respectively.

The sample obtained using a grounder of naphthol dye, C.I.A.C.C. 2, the sample obtained using a grounder of naphthol dye, C.I.A.C.C. 12, the sample obtained using a grounder of naphthol dye, C.I.A.C.C. 10 and the sample obtained using a grounder of naphthol dye, C.I.A.C.C. 13 were designated as sample No. 1, sample No. 2, sample No. 3 and sample No. 4, respectively. An ordinary regenerated cellulose fiber spun without adding any grounder of naphthol dye for comparison was designated as comparative sample No. 1.

Spun yarns with a yarn count of 19.68 tex were prepared from each of the samples No. 1 to No. 4 and the comparative sample No. 1 using a quick spin system (model: QSS-R20, made by SDL International Ltd.), with which knitted fabrics for socks were prepared, respectively. The knitted fabreics for socks obtained from the samples No. 1, No. 2, No. 3, No. 4 and the comparative sample No. 1 were designated as samples No. 5', No. 6', No. 7', No. 8' and comparative sample No. 2', respectively.

Each of obtained knitted fabrics for socks of No. 5' to No. 8' and the comparative sample No. 2' was dyed in a dyeing bath containing 5.0% owf of a developer of naphthol dye, C.I.A.D.C. 3 (trade name: Kako Scarlet GG salt, made by Showa Chemical Co., Ltd.), 2.0 g/l of sodium acetate and 2 g/l of nonionic surfactant (trade name: Clean N-15, made by Ipposha Oil Industries Co., Ltd.), at a liquor ratio of 1:30 at 40° C. for 30 minutes, washing, then soaped in a treating solution containing 2.0 g/l of a surfactant (trade name: Adekanol TS-403A, made by Asahi Denka Kogyo K.K.) and 2.0 g/l of sodium carbonate, at a liquor ratio of 1:30 at 80° C. for 20 minutes, followed by washing and drying at 102° C. to obtain the sample No. 5 of knitted fabric for socks dyed in light yellowish red, the sample No. 6 of knitted fabric for socks dyed in deep yellowish brown, the sample No. 7 of knitted fabric for socks dyed in deep yellowish red, the sample No. 8 of knitted fabric for socks dyed in light reddish brown and the comparative sample No. 2 of knitted fabric for socks dyed in very light reddish yellow, respectively.

Fineness, tensile strength at standard state, strength in wet state, knot strength and content of the grounder were measured for each of the obtained samples No. 1 to No. 4 and the comparative sample No. 1. Results are shown in Table 1. In addition, dyeability and color fastness were measured for each of the dyed samples No. 5 to No. 8 and the comparative sample No. 2. Results are shown in Table 2.

TABLE 1

| | No. 1 | No. 2 | No. 3 | No. 4 | Comparative sample No. 1 |
|---|---|---|---|---|---|
| Fineness (dtex) | 1.39 | 1.41 | 1.40 | 1.43 | 1.38 |
| Tensile strength at standard state (cN/dtex) | 4.02 | 3.93 | 3.91 | 3.87 | 4.08 |
| Tensile strength in wet state (cN/dtex) | 3.02 | 2.87 | 2.85 | 2.78 | 3.04 |
| Knot strength (cN/dtex) | 2.17 | 2.15 | 2.12 | 2.05 | 2.18 |
| Elongation (%) | 11.5 | 11.2 | 11.3 | 10.8 | 11.0 |
| Name of grounder | C. I. A. C. C. 2 | C. I. A. C. C. 12 | C. I. A. C. C. 10 | C. I. A. C. C. 13 | — |
| Content of grounder (%) | 0.24 | 1.32 | 1.56 | 1.95 | — |

TABLE 2

| | No. 5 | No. 6 | No. 7 | No. 8 | Comparative sample No. 2 |
|---|---|---|---|---|---|
| Dyeability (K/S value) | 2 | 11 | 16 | 1 | 0.1 |

TABLE 2-continued

| | | No. 5 | No. 6 | No. 7 | No. 8 | Comparative sample No. 2 |
|---|---|---|---|---|---|---|
| Color fastness to light (grade) | | 2 | 4< | 4< | 3 | 1–2 |
| Color fastness to rubbing (grade) | Dry | 5 | 4 | 4 | 5 | 5 |
| | Wet | 4 | 2–3 | 2–3 | 4 | 4–5 |
| Color fastness to washing (grade) | Discoloration | 5 | 5 | 5 | 5 | 5 |
| | Cotton staining | 5 | 5 | 5 | 5 | 5 |

As obvious from Table 1 and Table 2, fiber properties of Samples No. 1 to No. 4 containing a grounder of naphthol dye in the regenerated cellulose fiber are slightly lowered compared with those of the comparative sample No. 1 containing no grounder, but the decreases are not so large that would cause any trouble in practical use.

The content of grounder of naphthol dye was found to vary remarkably depending on the degree of affinity to regenerated cellulose fiber.

Contents of grounder of naphthol dye in the sample No. 2 obtained using C.I.A.C.C. 12, a grounder of naphthol dye belonging to the group having a medium level of affinity to regenerated cellulose fiber and grounder of naphthol dye in the sample No. 3 obtained using C.I.A.C.C. 10, a grounder of naphthol dye belonging to the group having a high level of affinity to regenerated cellulose fiber are 1.32 and 1.56, respectively. K/S values indicating dyeabilities of the sample No. 6 and the sample No. 7 obtained by dyeing the above two samples are so high as 11 and 16, respectively, showing that these samples obviously have more superior dyeabilities as well as higher to highest color fastness than other samples.

The sample No. 1 obtained using C.I.A.C.C. 2, a grounder of naphthol dye belonging to the group having a low level of affinity to regenerated cellulose fiber shows the lowest content of grounder of naphthol dye, and K/S value indicating dyeability of the sample No. 5 obtained by dyeing the above sample is so low as 2, obviously showing that this sample is not preferable due to an extremely poor dyeability and a low color fastness.

The sample No. 4 obtained using C.I.A.C.C. 13, a grounder of naphthol dye belonging to the group having a high level of affinity to regenerated cellulose fiber shows the highest content of grounder of naphthol dye, but K/S value indicating dyeability of the sample No. 8 obtained by dyeing the above sample is 1, showing an extremely poor dyeability resulting from an inhibition of the coupling reaction due to a strong interaction with cellulose molecules in the regenerated cellulose fiber.

Example 2

A mixture of 350 g of C.I.A.C.C. 10 Grounder (trade name: Kako Grounder E, made by Showa Chemical Co., Ltd.), 280 g of ethanol, 175 g of Turkey red oil and 350 g of pure water was made mud-like, then dissolved under stirring in a hot sodium hydroxide solution prepared by adding 995 g of pure water to 350 g of 48% aqueous sodium hydroxide solution heated at 60° C. Subsequently, about 2500 g of pure water was further added so that a concentration of C.I.A.C.C. 10 became 7.0% to obtain 5000 g of stock solution containing 7.0% of C.I.A.C.C. 10.

Procedures as in Example 1 were conducted except for that the prepared stock solution containing 7.0% of a grounder of naphthol dye was added and mixed to a polynosic viscose solution so that a content of grounder of naphthaol dye became 0.1%, 1.0%, 1.5%, 3.0% and 5.0% to the weight of cellulose in the polynosic viscose solution, and about 1000 g each of modified regenerated cellulose fibers of Samples No. 9 to No. 14 were produced without fiber break.

Spun yarns with a yarn count of 19.68 tex were prepared from the samples No. 9 to No. 13 using a quick spin system (model: QSS-R20, made by SDL International Ltd.), with which knitted fabrics for socks were prepared, respectively. The knitted fabrics for socks obtained from the samples No. 9, No. 10, No. 11, No. 12 and the comparative sample No. 13 were designated as samples No. 14', No. 15', No. 16', No. 17' and comparative sample No. 18', respectively.

Each of obtained knitted fabrics for socks of No. 14' to No. 18' was dyed in a dyeing bath containing 5.0% owf of developer of naphthol dye, C.I.A.D.C. 20 (trade name: Kako Blue BB salt, made by Showa Chemical Co., Ltd.), 2.0 g/l of sodium acetate and 2 g/l of nonionic surfactant (trade name: Clean N-15, made by Ipposha Oil Industries Co., Ltd.), at a liquor ratio of 1:30 at 40° C. for 30 minutes, washing, then soaped in a treating solution containing 2.0 g/l of surfactant (trade name: Adekanol TS-403A, made by Asahi Denka Kogyo K.K.) and 2.0 g/l of sodium carbonate, at a liquor ratio of 1:30 at 80° C. for 20 minutes, followed by washing and drying at 102° C. to obtain the samples No. 14 to No. 18 dyed in light reddish blue color to deep blue color with different deepness.

Fineness, tensile strength at standard state, tensile strength in wet state, knot strength and content of the grounder were measured for each of the obtained samples No. 9 to No. 13. Results are shown in Table 3. In addition, dyeability and color fastness were measured for each of the dyed samples No. 14 to No. 18. Results are shown in Table 4.

TABLE 3

| | No. 9 | No. 10 | No. 11 | No. 12 | No. 13 |
|---|---|---|---|---|---|
| Fineness (dtex) | 1.38 | 1.40 | 1.41 | 1.44 | 1.45 |
| Tensile strength at standard state (cN/dtex) | 4.08 | 4.04 | 4.01 | 3.87 | 3.28 |
| Tensile strength in wet state (cN/dtex) | 3.03 | 2.89 | 2.80 | 2.73 | 2.12 |
| Knot strength (cN/dtex) | 2.16 | 2.13 | 2.09 | 2.06 | 1.55 |
| Elongation (%) | 11.7 | 11.5 | 11.4 | 11.1 | 10.9 |
| Content of grounder (%) | 0.09 | 0.98 | 1.45 | 2.96 | 4.94 |

TABLE 4

| | | No. 14 | No. 15 | No. 16 | No. 17 | No. 18 |
|---|---|---|---|---|---|---|
| Dyeability (K/S value) | | 3 | 22 | 24 | 35 | 38 |
| Color fastness to light (grade) | | 3 | 4< | 4< | 4< | 4< |
| Color fastness to rubbing (grade) | Dry | 5 | 4 | 4 | 4 | 3–4 |
| | Wet | 4 | 3 | 2–3 | 2–3 | 2 |
| Color fastness to washing (grade) | Discoloration | 5 | 5 | 5 | 5 | 5 |
| | Cotton staining | 5 | 5 | 5 | 5 | 5 |

In Table 3 and Table 4, the samples No. 10 to No. 12, which have contents of grounder of naphthol dye in the range of 0.5–3.0%, show only slight lowering in tensile strength, and dyed samples No. 15 to No. 17 have K/S values of 8 or more indicating to satisfy a medium deepness as well as high color fastnesses. Thus, it is obvious that superior samples were obtained.

The sample No. 13 which contains 3.0% or more of grounder of naphthaol dye is not preferable because it shows a larger lowering in tensile strength compared with the samples No. 10 to No. 12 which have contents of grounder of naphthol dye in the range of 0.5–3.0%, as well as a lowered color fastness. In addition, K/S value indicating dyeability does not increase in proportion to the content of grounder of naphthol dye showing almost in a saturated state. Thus, it is obvious that a further increase of the content would not result in any improvement of dyeability performance.

The dyed sample No. 14 from the sample No. 9 having the content of grounder of naphthol dye not higher than 0.5% is not preferable because it has a K/S value indicating dyeability being so low as 3, and can not meet for medium to deep color though it can meet only for light color.

Example 3

A modified regenerated cellulose fiber containing 1.45% of a grounder of naphthol dye, C.I.A.C.C. 10 was obtained by a procedure as for the sample No. 11 in Example 2. A mixed yarn with a yarn count of 19.68 tex was produced from 20% of the modified regenerated cellulose fiber and 80% of ordinary cotton using a quick spin system (model: QSS-R20, made by SDL International Ltd.), then a knitted fabric for socks was prepared using this yarn.

The obtained knitted fabric for socks was dyed in a dyeing bath containing 1.0% owf of a developer of naphthol dye, C.I.A.D.C. 20 (trade name: Kako Blue BB salt, made by Showa Chemical Co., Ltd.), 2.0 g/l of sodium acetate and 2 g/l of a nonionic surfactant (trade name: Clean N-15, made by Ipposha Oil Industries Co., Ltd.) at a liquor ratio of 1:30 at 40° C. for 30minutes, washing, then treated in a scouring/bleaching solution containing 0.14% owf of 35% hydrogen peroxide, 0.1% owf of a stabilizer for hydrogen peroxide (trade name: Toraipon A-74, made by Ipposha Oil Industries Co., Ltd.), 0.1% owf of penetrating agent for scouring (trade name: Clean N-15, made by Ipposha Oil Industries Co., Ltd.), 0.05% owf of a sequestering agent (trade name: Kurewat DP-80, made by Teikoku Chemical Industries Co., Ltd.) and 0.05% owf of sodium hydroxide at a liquor ratio of 1:30 at 90° C. for 30 minutes, followed by washing, centrifugal dehydtation and then drying with hot air at 102° C. to obtain sample No. 19 of a dyed knitted fabric for socks. Color fastnesses of the obtained sample No. 19 were measured, and results are shown in Table 5.

TABLE 5

| | | No. 19 |
|---|---|---|
| Color fastness to light (grade) | | 4< |
| Color fastness | Dry | 5 |
| to rubbing (grade) | Wet | 4 |
| Color fastness | Discoloration | 5 |
| to washing (grade) | Cotton staining | 5 |

The sample No. 19 of dyed knitted fabric for socks was dyed selectively so that only the modified regenerated cellulose fiber constituting the knitted fabric for socks was dyed in deep dark blue, while staining of cotton was very slight staining. By the scouring/bleaching treatments performed after the dyeing, vividness of hue increased but little change in color deepness was observed. As obvious from Table 5, the sample having excellent color fastnesses was obtained.

The invention claimed is:

1. A method for dyeing regenerated cellulose fiber comprising the steps of:

adding and mixing 0.5–3.0% by weight of a grounding agent of naphthol dye into a polynosic viscose solution; said weight of grounding agent of naphthol dye based on the weight of cellulose in the polynosic viscose solution; said grounding agent of naphthol dye being selected from the group having a medium to high level of affinity to the regenerated cellulose fiber;

extruding the polynosic viscose solution into a spinning bath to produce a modified regenerated cellulose fiber containing the grounder of naphthol dye therein; and dyeing the modified cellulose fibers by using a diazo component as a developer of naphthol dye.

2. A method for dyeing regenerated cellulose fiber comprising the steps of:

adding and mixing 0.5–3.0% by weight of a grounding agent of naphthol dye to the regenerated cellulose fiber into a polynosic viscose solution; said weight of grounding agent of naphthol dye based on the weight of cellulose in the polynosic viscose solution; said grounding agent of naphthol dye being selected from the group having a medium to high level affinity to the regenerated cellulose fiber;

extruding the polynosic viscose solution into a spinning bath to produce a modified regenerated cellulose fiber containing the grounder of naphthol dye therein;

mixing or knitting/weaving the modified regenerated cellulose fiber with other cellulose-based fiber;

dyeing the mixture of the cellulose fibers by using a diazo component as a developer of naphthol dye; and further dyeing the products by a reactive dye.

3. A method for producing mélange yarns comprising the steps of:

adding and mixing 0.5–3.0% by weight of a grounding agent of naphthol dye into a polynosic viscose solution; said weight of grounding agent based on the weight of cellulose in the polynosic viscose solution; said grounding agent of naphthol dye being selected from the group having a medium to high level of affinity to the regenerated cellulose fiber;

extruding the polynosic viscose solution into a spinning bath to produce a modified regenerated cellulose fiber containing the grounder of naphthol dye therein;

mixing the modified regenerated cellulose fiber containing a grounder of naphthol dye with other cellulose-based fiber; and then dyeing the cellulose fibers by using a diazo component as a developer of naphthol dye to obtain mélange yarns.

4. A method for producing mélange yarns according to claim 1, wherein the method further includes step of dyeing the mixture of cellulose fibers by a reactive dye.

* * * * *